United States Patent [19]

Lerner

[11] 4,005,379

[45] Jan. 25, 1977

[54] R.F. POWER DISTRIBUTION NETWORK FOR PHASED ANTENNA ARRAY

[75] Inventor: David S. Lerner, Fanwood, N.J.

[73] Assignee: Lockheed Electronics Co., Inc., Plainfield, N.J.

[22] Filed: Nov. 4, 1975

[21] Appl. No.: 628,469

[52] U.S. Cl. ..... 333/6; 333/21 R; 333/83 R; 343/854

[51] Int. Cl.[2] ..... H01P 5/12; H01P 7/06

[58] Field of Search ..... 333/6, 10, 21 R, 83 R; 343/854

[56] References Cited

UNITED STATES PATENTS 3,728,648 4/1973 Lerner ..... 333/6

3,863,255 1/1975 Iden ..... 343/854 X

*Primary Examiner*—Paul L. Gensler

[57] ABSTRACT

An r.f. power distribution network or scanner in which a TEM mode and a pair of selectively phase-shifted $TE_{11}$ modes are derived and applied to input ports of a cavity resonator to produce a desired r.f. power distribution at a plurality of output ports. The resonator is in the form of a generally cylindrical member in which the output ports are arranged circumferentially about the periphery and axially spaced from the $TE_{11}$ mode input ports. The latter are arranged symmetrically about the TEM mode input port.

5 Claims, 5 Drawing Figures

R.F. POWER DISTRIBUTION NETWORK FOR PHASED ANTENNA ARRAY

The present invention relates generally to r.f. power distribution, and more particularly to an improved system for supplying r.f. power to a plurality of radiators in a phased array according to a desired distribution pattern.

In the operation of a phased array antenna, the radiators in the array are scanned, that is, r.f. power is supplied to each radiator in the array at a relative predetermined phase and amplitude, so that the phased array will radiate a desired radiation pattern that is the resultant of the individual radiation patterns produced by the radiators in the array.

Prior art approaches used in scanning phased arrays have included mechanical and electronic devices which were relatively complex, bulky and inefficient. In U.S. Pat. No. 3,728,648, there is disclosed a power distribution network for supplying r.f. power to phased arrays in which a TEM mode and crossed $TE_{11}$ modes are combined in a scanner to yield a so-called "cosine-on-a-pedestal" amplitude distribution.

Although the distribution network disclosed in that patent has proven to be more efficient and less complex than the prior mechanical and electronic scanners, it nevertheless is still relatively large in size and low in efficiency.

It is, therefore, an object of the invention to provide and r.f. distribution system that is less bulky and more efficient in operation.

In accordance with the present invention, an r.f. power distribution system includes means for deriving phase-shifted $TE_{11}$ modes which are applied to a cavity resonator at 90°-spaced input ports arranged symmetrically about a TEM input port. A plurality of output ports, which may be respectively coupled to the radiators in the phased array, are arranged about the circumferential periphery of the resonator and are axially spaced from the $TE_{11}$ mode input ports.

To the accomplishment of the above and to such further objects as may hereinafter appear, the present invention relates to an improved r.f. scanner as defined in the amended claims and as described in the following specification taken in conjunction with the accompanying drawing in which:

Figure 1:
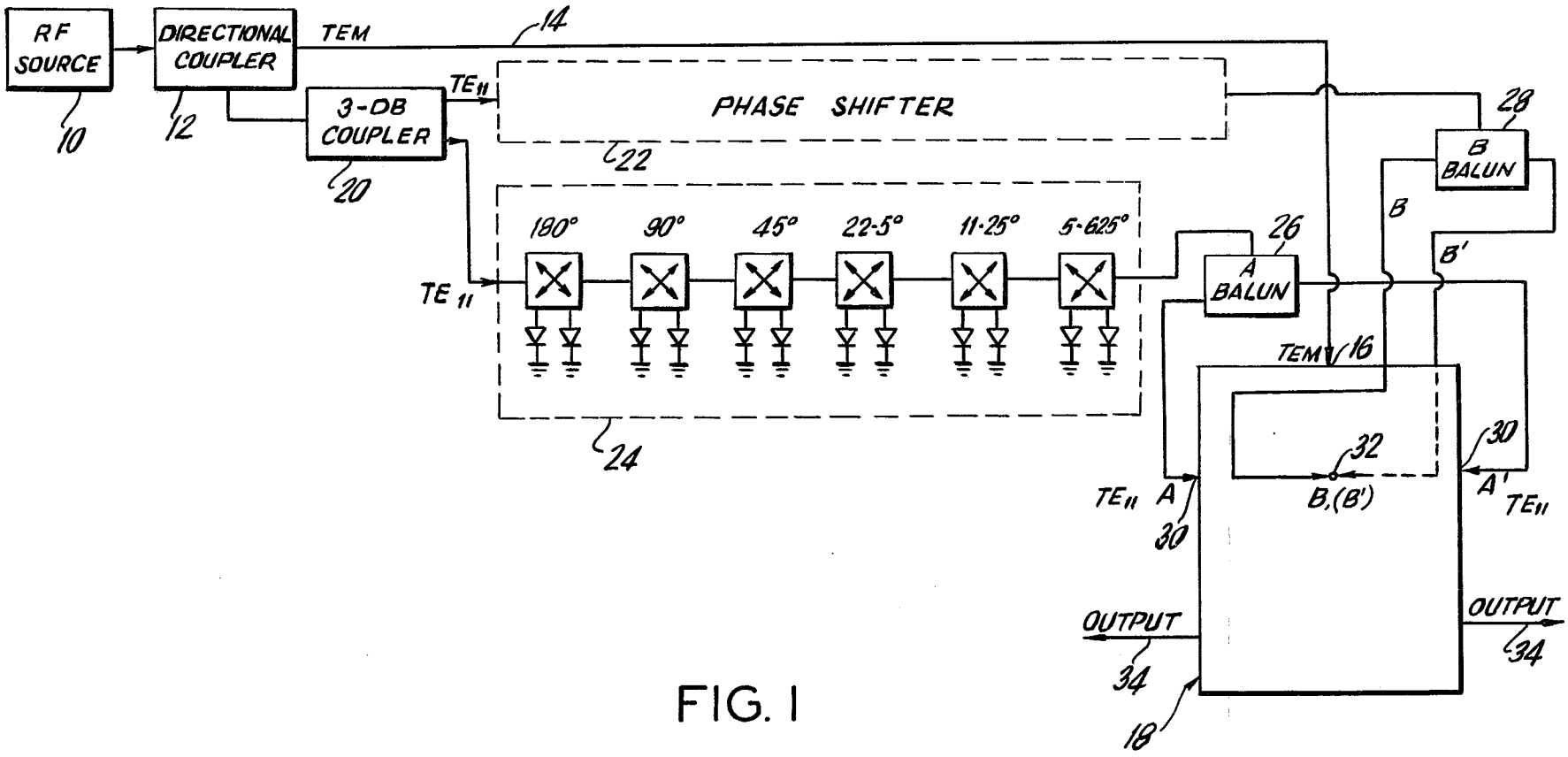
FIG. 1 is a diagram, in schematic form, of an r.f. power distribution network according to one embodiment of the invention.

Referring to FIG. 1, there is shown an r.f. power distribution network in which a directional r.f. input derived from an r.f. source 10 is applied to a directional coupler 12. The output of the through arm of the directional coupler is a TEM mode which appears on a transmission line or wave guide 14. Wave guide 14 is applied to one input port 16 of a cavity resonator generally designated 18, which is described in greater detail in a later part of the specification.

Figure 4A:
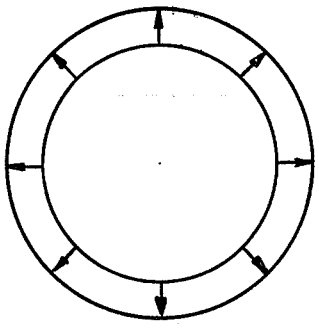
FIGS. 4*a* and 4*b* are typical TEM and $TE_{11}$ field distribution patterns established in the network of the invention.
Figure 4B:
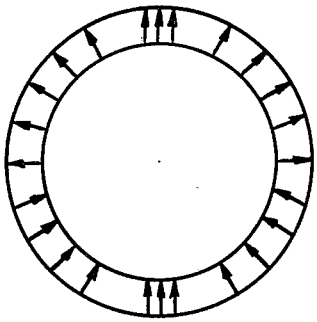

The coupled arm of directional coupler 12 is a $TE_{11}$ mode which is coupled to a 3-dB coupler 20, which applies the $TE_{11}$ mode to phase shifters 22 and 24. The phase shifters 22 and 24 are substantially identical so that only the latter is illustrated in detail. As shown, the phase shifters are in the form of a digital-type device consisting of 3-dB couplers in the 180° and 90° bits and using loaded lines to obtain the 45°, 22.5°, 11.25° and 5.625° bits. The 3-dB couplers are diode terminated and the desired overall phase shift to the $TE_{11}$ modes is achieved by selectively forward and reverse biasing the diodes. The phase shifted $TE_{11}$ modes, designated A and B, are respectively applied to baluns 26 and 28 which produce a 180° phase shift in these signals. The thus phase-shifted $TE_{11}$ modes A and B, which have a sinusoidal field distribution (FIG. 4*b*) are respectively applied to input ports 30 and 32 of the cavity resonator 18 to produce, in superposition with the TEM signal which has a uniform field distribution, (FIG. 4*a*) a desired non-uniform power distribution pattern at a plurality of output ports 34.

Figure 2:
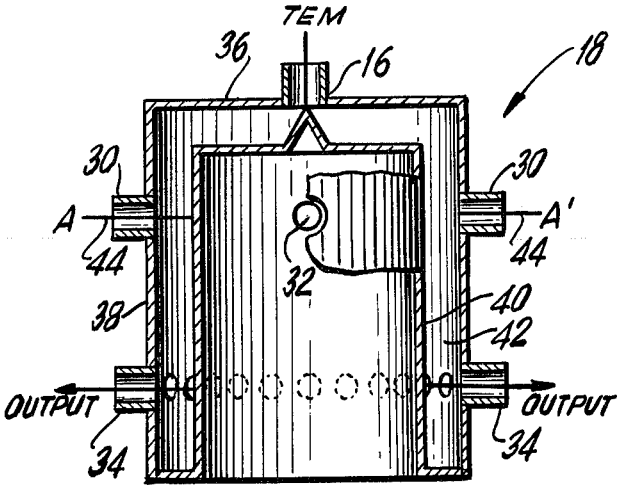
FIG. 2 is an elevation, partly broken away, of one form of a cavity resonator that may be used in the distribution network of FIG. 1.

In the embodiment of the invention illustrated in FIG. 2, the cavity resonator 18 is in generally cylindrical form having a coaxial input 16 for receiving the TEM input. The cylindrical resonator includes an upper wall 36 in which the TEM input is formed and a circumferential wall 38 depending therefrom. An interior cylindrical wall 40 defines with the cavity outer circumferential wall 38 an annular cavity 42. The A and B $TE_{11}$ mode input ports 30 and 32 are arranged about the circumferential wall of the cavity resonator and are displaced by 90° from one another and arranged symmetrically about the TEM input port 16, each pair of A and B $TE_{11}$ input ports 30 and 32 thus being spaced by 180°. The A and B $TE_{11}$ modes are introduced into the interior of the cavity by means of coupling loops 44 shown in FIG. 2 for the A $TE_{11}$ mode, it being understood that similar coupling loops are provided for the 180° phase-shifted B $TE_{11}$ mode signals. The output ports 34, which are in communication with the internal cavity 42, are preferably, although not necessarily, equally spaced, as shown in FIG. 2. Output ports 34 are disposed about the circumferential wall 38 of the cavity resonator and are axially spaced from the $TE_{11}$ mode input ports 30 and 32.

Figure 3:
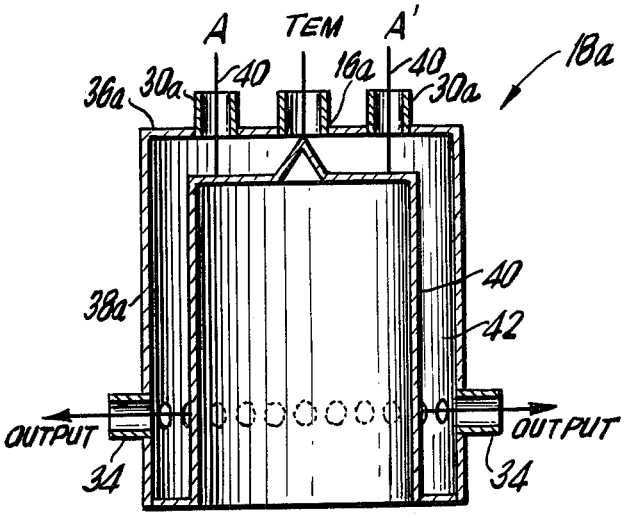
FIG. 3 is a cross-sectional illustration of an alternative cavity resonator that may be used in the distribution network of the invention.

FIG. 3 illustrates an alternative embodiment of a cavity resonator **18*a* according to the invention, which differs from the previously described embodiment primarily in that the $TE_{11}$ inlet ports 30*a* are diametrically arranged on the upper wall 36*a* of the resonator and surround the centrally from the arranged TEM input port 16*a*. Although not shown in FIG. 3, the cavity resonator also includes diametrically opposed B $TE_{11}$ mode input ports arranged on the resonator upper wall and spaced 90° from the A mode signal inlet ports. As before, the output ports 34** are formed about the periphery of the cavity resonator circumferential wall and are axially spaced fromthe TEM and $TE_{11}$ input ports.

It has been found that the cavity resonator arrangement described hereinabove produces a desired r.f. power distribution at the outlet ports which may be coupled, for example, through appropriate microwave couplers to the radiators of a phased array in a more efficient manner than has hereto been obtained. The r.f. power distribution produced at the output ports may be modified by varying either the amplitude and/or the relative phase shift of the $TE_{11}$ mode signals applied to the $TE_{11}$ inputs of the cavity resonator. The phase shift imparted to the A and B $TE_{11}$ modes may be equal and opposite but may also be established at any desired relation to one another such as by selectively biasing the terminating diodes in the A and B signal phase shifters, so as to produce the desired relationship between the $TE_{11}$ mode non-uniform signals to bring about the desired r.f. pattern at the output ports.

Thus, although the invention has been herein specifically described with respect to several embodiments thereof, it will be understood that modifications may be made therein without necessarily departing from the spirit and scope of the invention.

What is claimed is:

1. An r.f. power distribution network comprising a source of an r.f. input signal, means for dividing said input signal into a first signal and a second signal, a cavity resonator having first and second inlet port means, means for respectively applying said first and second signals to said first and second inlet port means, said cavity resonator being in the form of a first generally cylindrical member having a first annular upper wall and a first circumferential wall depending from said first annular upper wall, a second generally cylindrical member disposed within said first cylindrical member, said second cylindrical member having a second upper annular wall within said first cylindrical member and substantially parallel to said first annular wall and a second circumferential wall depending therefrom and coaxial with said first circumferential wall, the diameter of said second circumferential wall being the greater part of the diameter of said first circumferential wall, and wall means for connecting the ends of said first and second circumferential walls remote from said first and second upper walls, said first inlet port means being centrally formed on one of said upper walls, and said second inlet port means comprising a plurality of ports formed on one of said first upper wall and said first circumferential wall, and a plurality of spaced outlet ports arranged about the periphery of said first circumferential wall and axially spaced from said first and second inlet ports.

2. The power distribution network of claim 1, in which said second input port means includes a pair of inlet ports arranged on the periphery of said first circumferential wall and spaced 90° from one another.

3. The power distribution network of claim 1, in which said second inlet port means includes a pair of inlets formed on said upper wall and radially spaced from said first input port.

4. The power distribution network of claim 1, in which said first signal is a TEM mode signal and said second signal is a $TE_{11}$ mode signal, and further comprising means for producing a predetermined phase shift in said $TE_{11}$ mode signal.

5. A combination as in claim 1, wherein the spacing between said first and second cylindrical members is uniform.

* * * * *